US011651758B2

(12) United States Patent
Pachet et al.

(10) Patent No.: US 11,651,758 B2
(45) Date of Patent: May 16, 2023

(54) AUTOMATIC ORCHESTRATION OF A MIDI FILE

(71) Applicant: Spotify AB, Stockholm (SE)

(72) Inventors: François Pachet, Paris (FR); Pierre Roy, Paris (FR); Benoit Jean Carré, Paris (FR)

(73) Assignee: Spotify AB, Stockholm (SE)

( * ) Notice: Subject to any disclaimer, the term of this patent is extended or adjusted under 35 U.S.C. 154(b) by 402 days.

(21) Appl. No.: 17/063,347

(22) Filed: Oct. 5, 2020

(65) Prior Publication Data

US 2021/0125593 A1 Apr. 29, 2021

(30) Foreign Application Priority Data

Oct. 28, 2019 (EP) ..... 19205553

(51) Int. Cl.
*G10H 1/00* (2006.01)

(52) U.S. Cl.
CPC ..... *G10H 1/0066* (2013.01); *G10H 1/0025* (2013.01); *G10H 2240/021* (2013.01); *G10H 2240/056* (2013.01); *G10H 2240/305* (2013.01)

(58) Field of Classification Search
CPC ..... G10H 1/0066; G10H 1/0025; G10H 2240/021; G10H 2240/056; G10H 2240/305

(Continued)

(56) References Cited

U.S. PATENT DOCUMENTS 5,877,445 A 3/1999 Hufford et al.
7,842,874 B2 * 11/2010 Jehan ..... G10H 1/0025 84/634

(Continued)

FOREIGN PATENT DOCUMENTS

CN 109979418 B * 11/2022
DK 202170064 A1 * 5/2022

OTHER PUBLICATIONS

Cao, Z. et al., HashNet: Deep Learning to Hash by Continuation, In ICCV (2017), pp. 5609-5618, arXiv: 1702.00758v4 [cs.LG] Jul. 29, 2017, 11 pgs.

(Continued)

*Primary Examiner* — Christina M Schreiber
(74) *Attorney, Agent, or Firm* — Morgan, Lewis & Bockius LLP

(57) ABSTRACT

An electronic device segments a first and second MIDI files into pluralities of source segments and target segments. For each of a plurality of consecutive pairs of first and second target segments, the electronic device identifies a first source segment corresponding to the first target segment of the consecutive pair and identifies a second source segment corresponding to the second target segment of the consecutive pair, where the first and second source segments are identified by determining that the first and second source segments are harmonically conformant to the corresponding first and second target segments, and determining that a transition between the first and second source segments is graphically conformant to a transition between a consecutive pair of source segments. The electronic device generates a third MIDI file using the identified first and second source segments for each of the plurality of consecutive pairs of first and second target segments.

20 Claims, 3 Drawing Sheets

(58) Field of Classification Search
USPC ..... 84/609
See application file for complete search history.

(56) References Cited

U.S. PATENT DOCUMENTS

| | | | | |
|---|---|---|---|---|
| 8,735,709 | B2 * | 5/2014 | Yamauchi | G10H 1/10 84/622 |
| 10,165,357 | B2 * | 12/2018 | Bohrarper | G06F 16/639 |
| 11,024,276 | B1 * | 6/2021 | Dabby | G10H 1/0025 |
| 2008/0092721 | A1 | 4/2008 | Schnepel et al. | |
| 2008/0314228 | A1 * | 12/2008 | Dreyfuss | G09B 15/00 84/477 R |
| 2009/0019996 | A1 * | 1/2009 | Fujishima | G10H 1/0025 84/625 |
| 2010/0251876 | A1 * | 10/2010 | Wilder | G10H 3/125 84/609 |
| 2019/0237051 | A1 * | 8/2019 | Silverstein | G10H 1/368 |
| 2019/0378483 | A1 * | 12/2019 | Kiely | G10H 1/0025 |
| 2020/0380940 | A1 * | 12/2020 | Abdallah | G11B 27/031 |
| 2021/0028875 | A1 * | 1/2021 | Kiely | H04H 60/04 |
| 2021/0125593 | A1 * | 4/2021 | Pachet | G10H 1/0025 |
| 2021/0158791 | A1 * | 5/2021 | Pachet | G10H 5/02 |

OTHER PUBLICATIONS

Handelman, Eliot et al., "Automatic orchestration for automatic composition," Musical Metacreation: Papers from 2012 AIIDE Workshop, AAAI Technical Report WS-12-16, Association for the Advancement of Artificial Intelligence, 6 pgs.

Spotify AB, Communication Pursuant to Article 9 4(3), EP19205 5 5 3.1, dated Jul. 16, 2021, 7 pgs.

Pierre Roy et al., "Smart Edition of MIDI Files," arxiv.org, Cornell University Library, 201 Olin Library Cornell University Ithaca, NY 14853, Mar. 20, 2019, XP081155737, 20 pgs.

Ian Simon et al., "Audio Analogies: Creating New Music From An Existing Performance By Concatenative Synthesis," International Computer Music Conference Proceedings: vol. 2005, Jan. 1, 2005, XP055677811, from URL: http://citeseerx.ist.psu.edu/viewdoc/download?doi=10.1.1.481,6850&re_repl&type_pdf, 8 pgs.

Spotify AB, Extended EP Search Report, EP22152232.9, dated Apr. 22, 2022, 5 pgs.

Tristan Jehan, "Creating Music By Listening," Submitted to the program in Media Arts and Sciences, School of Architecture and Planning, in partial fulfillment of the requirements for the degree of Doctor of Philosophy at the Massachusetts Institue of Technology, Sep. 1, 2005, 137 pgs.

* cited by examiner

AUTOMATIC ORCHESTRATION OF A MIDI FILE

RELATED APPLICATION

This application claims priority to European Patent Application No. 19205553.1, filed Oct. 28, 2019, which is hereby incorporated by reference in its entirety.

BACKGROUND

Orchestration in general is a task consisting in distributing various musical voices or parts to musical instruments. As such, orchestration is not very different from composition. In practice however, orchestration is a task performed usually by arrangers, i.e. musicians able to compose music material that somehow reveals a given music target such as a melody, a motive, or a theme.

There is no real scientific basis for orchestration and most treatises consist of informed descriptions and analysis of existing examples. As a consequence, orchestration cannot be based on a model built from existing academic knowledge, as opposed to more constrained forms of musical polyphony.

Like most musical composition tasks, the orchestration problem (including its projective variant i.e., orchestration built from existing melodies) in general is ill-defined, as virtually all musical effects and means can be employed by the arranger to create a satisfying musical work. Even within the boundaries of tonal music, almost any instrument can be used. For a given instrument any musical production, provided they conform to the intrinsic limitations of the instrument such as its tessitura or playability constraints, can be employed.

SUMMARY

This disclosure provides a new MIDI file based on a source MIDI file and a target MIDI file. In some embodiments, the new MIDI file may be regarded as a re-orchestration of the target MIDI file based on the source MIDI file.

In one aspect, there is provided a method of automatically preparing an MIDI file based on a target MIDI file and a source MIDI file. The method comprises segmenting the source MIDI file into source segments, reordering at least some of the source segments, concatenating the reordered source segments to obtain a new MIDI file, preferably having the same length as the target MIDI file, and outputting the new MIDI file.

In another aspect, there is provided a non-transitory computer readable medium comprising computer-executable components for causing an electronic device to perform an embodiment of the method of the present disclosure when the computer-executable components are run on processing circuitry comprised in the electronic device.

In another aspect, there is provided an electronic device for automatically preparing an MIDI file. The electronic device comprises processing circuitry, and data storage storing instructions executable by said processing circuitry whereby said electronic device is operative to segment a source MIDI file into source segments, reorder at least some of the source segments, concatenate the reordered source segments to obtain a new MIDI file, preferably having the same length as a target MIDI file, and outputting the new MIDI file.

As a result of the embodiments described herein, a new MIDI file can be automatically prepared based on two existing MIDI files, herein called target and source MIDI files. By the source segments being reordered in relation to the source MIDI file, the new MIDI file differs from the source MIDI file. By the new MIDI file having the same length (in time, i.e. duration) as the target MIDI file, the new MIDI file may be outputted (e.g., played) together with the target MIDI file, which may be preferred in some embodiments.

BRIEF DESCRIPTION OF THE DRAWINGS

Embodiments will be described, by way of example, with reference to the accompanying drawings, in which.

DETAILED DESCRIPTION

Embodiments will now be described more fully hereinafter with reference to the accompanying drawings, in which certain embodiments are shown. However, other embodiments in many different forms are possible within the scope of the present disclosure. Rather, the following embodiments are provided by way of example so that this disclosure will be thorough and complete, and will fully convey the scope of the disclosure to those skilled in the art. Like numbers refer to like elements throughout the description.

The embodiments described herein reference Musical Instrument Digital Interface (MIDI) as an example technical standard that describes a communications protocol and file format for an electronic music score. Reference to MIDI is not meant to be limiting; the concepts described herein may be applied to any other type of electronic music-based communications protocol and/or file format.

In accordance with some embodiments, a new MIDI file is generated as what is herein called an orchestration of a target MIDI file in the style of a source MIDI file. The target MIDI file may have a melody, a chord sequence, or both, and may generally be any multitrack MIDI file. Similarly, the source MIDI file may also be any multitrack MIDI file, typically a capture of a musical performance. Herein, orchestration may be seen as a sequence generation problem in which a good trade-off is found between 1) harmonic conformance of the generated new MIDI file to the target MIDI file and 2) sequence continuity with regards to the source MIDI file.

The generated MIDI file may be intended to be played along with the target MIDI file, e.g., as a combined MIDI file. However, other use cases are also envisioned.

On one hand, the new MIDI file may be in the style of the source MIDI file, e.g., preserving as much as possible of expression, transitions, groove, and idiosyncrasies. On the other hand, the new MIDI file may be harmonically, and, to some extent, rhythmically compatible with the target MIDI file.

Figure 1:
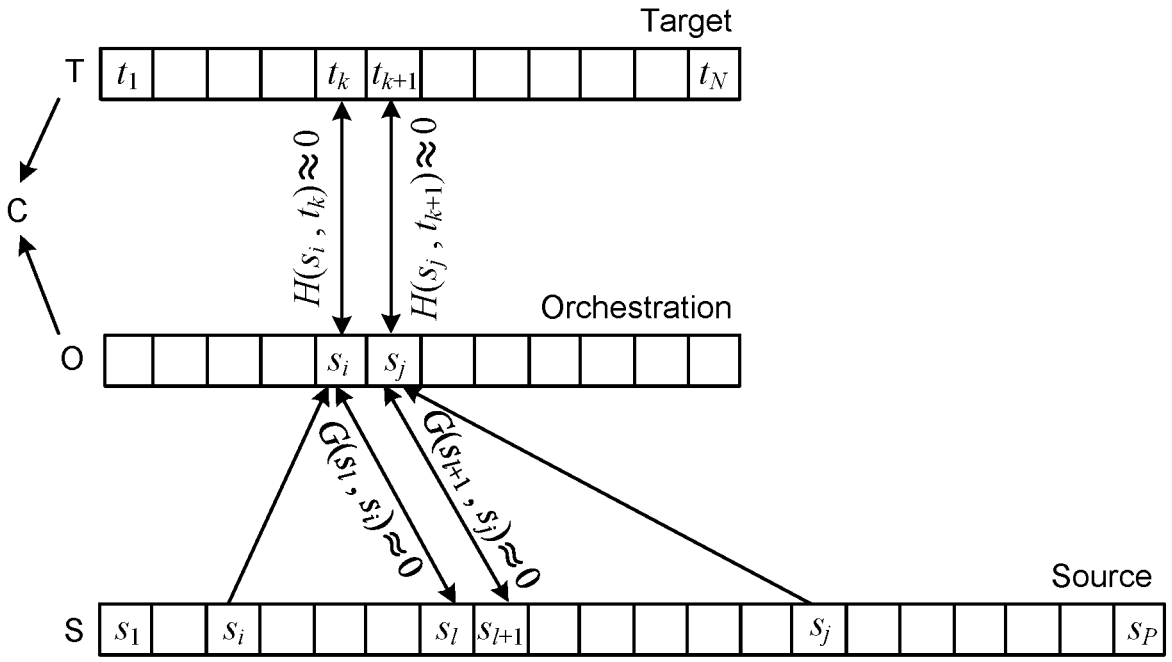
FIG. 1 schematically illustrates a segmented target MIDI file, a source MIDI file, and a new MIDI file, wherein the new MIDI file is made from reordered segments of the source MIDI file to a length corresponding to the target MIDI file, in accordance with some embodiments.

In accordance with FIG. 1, given a target MIDI file T and a source MIDI file S, a new MIDI file O is automatically prepared (by electronic device 30, described in more detail with reference to FIG. 3 below). The new MIDI file O may be generated from the source MIDI file S as an orchestration of the target MIDI file T.

The target and source MIDI files T and S are segmented, preferably in equal-length segments, e.g., one-beat-long or one-measure-long segments, such that the target MIDI file T is segmented into N target segments t and the source MIDI file S is segmented into P source segments s. Optionally, in order to be tonality-invariant, the source segments s may be transposed, for example 12 times (e.g., from five semitones down to six semitones up, depending on the pitch range of the source MIDI file S).

When reordering the source segments s to form the sequence of segments for the new MIDI file O, one or some segments may be used several times. Thus, the new MIDI file may in some cases be formed from fewer source segments s than there are target segments t in the target MIDI file. Also, domain augmentation may be used to generate a plurality of segments for the new MIDI file sequence of segments from a single source segment. Thus, the source MIDI file S need not have at least the same length in time as the target MIDI file T to form the new MIDI file having the same length as the target MIDI file. It is noted that when it is herein referred to MIDI files, it is often the audio encoded by the MIDI file which is intended. The length of a MIDI file, or a segment thereof, may thus be regarded as, e.g., the number of bars or beats of the audio encoded thereby, or a time duration of the audio when played at a predetermined tempo.

The new MIDI file O is produced by reordering at least some of the (optionally transposed) source segments s and then concatenating the reordered source segments to create a new sequence of the same duration as the target MIDI file T. In the example of FIG. 1, the new MIDI file O is a concatenation of N source segments s, and each target segment t is aligned with a source segment s in the new MIDI file, e.g., a first target segment $t_k$ is aligned with a first source segment $s_i$ in the new MIDI file, and a sequentially following second target segment $t_{k+1}$ is aligned with a sequentially following second source segment $s_j$ in the new MIDI file.

In some embodiments, the first and second source segments $s_i$ and $s_j$ may be chosen so that either or both of properties (i) and (ii), below, are satisfied:

(i) Each source segment s in the new MIDI file O is harmonically conformant to the corresponding target segments t to which the source segments s are aligned, for instance $H(s_i, t_k)$ and $H(s_j, t_{k+1})$ are relatively small, where H is a harmonic distance that indicates the harmonic similarity between the MIDI segments. The harmonic distance H may correspond to a harmonic probability for choosing a source segment s to be aligned with a target segment t. Thus, a smaller harmonic distance H, corresponding to a higher harmonic similarity, results in a higher harmonic probability that a source segment s from the source MIDI file S is chosen to be included in the new MIDI file O and aligned with its corresponding target segment t. This is in FIG. 1 illustrated by $H(s_i, t_k)$ and $H(s_j, t_{k+1})$ each being close to zero.

(ii) The transition between each two consecutive source segments s in the new MIDI file O is musically similar to a transition between two consecutive source segments s in the source MIDI file S, other than the two consecutive source segments s in the new MIDI file O (since the source segments s in the new MIDI file O are reordered compared with the source MIDI file S). Looking again at the two consecutive source segments $s_i$ and $s_j$ in the new MIDI file O, they are in FIG. 1 compared with the two consecutive source segments $s_l$ and $s_{l+1}$ in the source MIDI file S. The transition from $s_i$ to $s_j$ in the new MIDI file O is musically similar to the transition from $s_l$ to $s_{l+1}$ in the source MIDI file S with respect to a graphical distance G that measures the similarity between source segments s. The graphical distance G is herein defined based on graphical distance between piano rolls (see below). In the example of FIG. 1, if both of the graphical distances $G(s_l, s_i)$ and $G(s_{l+1}, s_j)$ are small, the transitions are musically similar. This is illustrated in FIG. 1 by both $G(s_l, s_i)$ and $G(s_{l+1}, s_j)$ being close to zero. Thus, smaller graphical distances G, corresponding to higher musical similarities of the transitions, result in a higher graphical probability that source segments $s_i$ and $s_j$ are chosen as consecutive source segments s in the new MIDI file O.

Property (i) aims at ensuring that the new MIDI file O is conformant to the target MIDI file. The harmonic distance H(s, t) is typically close to zero if segments s and t use the same notes (or same pitch-classes). Conversely, H(s, t) is typically much more than zero if segments s and t contain different pitch-classes.

Property (ii) states that two source segments s, here $s_i$ and $s_j$, can be concatenated in this order if there exists an index $l<P$ such that $G(s_l, s_i)$ is close to zero and $G(s_{l+1}, s_j)$ is close to zero.

It can be noted that the graphical distance G may be endogenous to the source MIDI file S, whereas the harmonic distance H is computed between source and target segments s and t and is thus agnostic in terms of composition and performance style of the audio represented by the MIDI files.

The distances H and G may, each or both together, be used to compute costs, such that a harmonic cost is computed using the harmonic distance H and/or a transition cost is computed using the graphical distances G. These costs may be interpreted as probabilities, harmonic probability and graphical probability, respectively, to be used by a sampling algorithm, e.g., using Belief Propagation as discussed further below.

Harmonic Distance

The harmonic distance H between source and target segments s and t may be based on a comparison between the pitch profiles of the two segments s and t. In order to remain as independent as possible from the music style of the sources and target MIDI files S and T, a simple pitch profile distance may be used which is not tuned for Western tonal music (e.g., taking into account the salience of pitches in a given scale). In practice, the harmonic distance H may be computed between Boolean matrices that represent corresponding piano rolls of the segments s and t. More precisely, for each segment s and t of length b beats, all the tracks of the respective MIDI files may be mixed together, and a Boolean matrix may be computed of size (128, 12b), such that a number 1 at position (i, j) in the matrix indicates that at least one note of pitch i is playing at time j. These matrices may be referred to as merged piano rolls. Each matrix may then be folded modulo 12 (octave folding) as we only care about harmony, not absolute pitches, resulting in a Boolean matrix of dimensions (12, 12b), in which a number 1 at position (I, j) indicates that at least one note with pitch p such that p mod 12=i is playing at temporal position j. These matrices may be referred to as modulo 12 piano rolls.

The harmonic distance H(t, s) between a target segment t and a source segment s may be computed by considering three quantities extracted from the modulo 12 piano roll $p_s$ and $p_t$, for segments t and s respectively:

1. Quantity c is the number of common active bits in $p_s$ and $p_t$.
2. Quantity m is the number of active bits in $p_t$ that are inactive in $p_s$, which corresponds to active notes in the target segment t that are missing in the source segment s.
3. Quantity f is the number of active bits in $p_s$ that are inactive in $p_t$, which corresponds to active notes in the source segment s that are missing in the target segment t, which may be called foreign notes.

Then, the harmonic distance H(s, t) may be defined as $$H(s, t) = \frac{c}{c + w_m m + w_f f} \tag{1}$$

where $w_m$ and $w_f$ represent weights of missing and foreign notes respectively. These weights may allow, e.g., a user to tailor the harmonic distance H for achieving specific musical effects.

Graphical Distance

Embodiments of the method of the present disclosure automatically prepare a new MIDI file O by recombining source segments s of the source MIDI file S, which results in new transitions between existing segments s. The quality of such a new transition may be measured in relation to the transitions between source segments s in the source MIDI file S. For example, if the source MIDI file S has unusual transitions that do not appear in other existing music, it may be desirable to reproduce such transitions in the new MIDI file O. In contrast, a general model may rank such transitions with a low score and will therefore not reproduce them.

The quality of a transition may not depend only on harmonic features, but also on rhythm and on absolute pitches, e.g., to prevent very large melodic intervals in transitions. Therefore, contrarily to the harmonic distance H, which may rely on modulo 12 piano rolls, the graphical distance G may rely on merged piano rolls, which retain information about absolute pitches. The graphical distance G between any source segments $s_x$ and $s_y$ (see also property (i) and FIG. 1) may be implemented by computing the Hamming distance between the two merged piano rolls, i.e., the number of bit-positions where the bits differ in the two matrices. The Hamming distance may be normalized to within the range from 0 to 1.

$$G(s_x, s_y) = \frac{\text{Hamming}(PR(s_x), PR(s_y))}{128 \times 12b} \tag{2}$$

where PR(s) is a Boolean matrix representing the piano roll of MIDI segments, and b is the length, in beats, of the segment s.

Sequence Generation

Using the harmonic and graphical distances H and G, reordered sequences of source segments s for the new MIDI file O may be generated, e.g., using Belief Propagation. This algorithm may sample solutions according to probabilities for harmonic conformance (unary factors or local fields) and for transitions (binary factors). The Belief Propagation typically requires two probabilities, which may be obtained from the harmonic and graphical distances H and G, respectively, e.g., as follows:

Unary factor: For a given target segment t, the probability $$P(s_j) = \frac{1}{Z_H} H(s_j, t),$$

where $Z_H = \Sigma_j H(s_j, t)$ is a normalization factor.

Binary factor: The probability that segment $s_j$ follows segment $s_i$ in the generated sequence of the new MIDI file may be defined as $$P(s_j \mid s_i) = \frac{1}{Z_G}\left(1 - \min_{1 \le l \le P} \frac{G(s_i, s_l) + G(s_j, s_{l+1})}{2}\right. \tag{3}$$

where $$Z_G = \sum_j \left(1 - \min_{1 \le l \le P} \frac{G(s_i, s_l) + G(s_j, s_{l+1})}{2}\right.$$

is a normalization factor ensuring that $P(.,s_i)$ is a probability distribution. This probability is close to 1 whenever there exists a source segment $s_l$, such that $s_l \approx s_i$ and $s_l+1 \approx s_j$. This indicates that the transition $s_l \rightarrow s_l+1$, which exists in the source MIDI file S is similar to the transition $s_i \rightarrow s_j$.

In practice, the number of $s_j$ may be in O(l), where l is the size of the source MIDI file, why computing the two normalization factors $Z_H$ and $Z_G$ is typically fast.

Thus, a plurality of possible source segment sequences for the new MIDI file may be ranked by means of the harmonic and/or graphical probabilities based on the harmonic and/or graphical distances H and G. Typically, a highly ranked source segment sequence, i.e., with high probabilities (low distance(s)), e.g., the most highly ranked, may be chosen for the new MIDI file O which is then outputted, e.g., to a storage internal to the electronic device preparing the new MIDI file or to another electronic device such as a smartphone or smart speaker.

Domain Augmentation

In some embodiments, the source segments s used for the new MIDI file O may be adjusted (augmented) to provide more creatively novel versions of the new MIDI file. In domain augmentation, as used herein, each source segment s can be transformed to create better fits to a target segment t with which it is aligned. Formally, this may comprise generating samples s' of a source segment s, for a given pair of aligned source and target segments (s, t) so that:

$$G(s,s') < \varepsilon, \text{ for an } \varepsilon > 0 \tag{4}$$

and $$H(t,s') < H(t,s) \tag{5}$$

A possible mechanism to achieve this is by means of machine learning model, e.g., using a Variational Autoencoder (VAE), e.g., in accordance with Roberts, A., Engel, J., Raffel, C., Hawthorne, C., and Eck, D. "A hierarchical latent vector model for learning long-term structure in music", CoRR abs/1803.05428 (2018). By training a VAE on a large set of MIDI files, it may be possible to explore the intersection between an imagined sphere around a source segment s and another sphere around a target segment t in the corresponding latent space. Another approach to domain augmentation may comprise exploring small variations around each source segment s using ad hoc variation generators. This may allow control of the amount of creativity of the system preparing the new MIDI file O.

In some embodiments, any transformation of the source segment s may be used for domain augmentation. For example, the "reversed" source segment may be used (produced by reversing the order of each note in the segment), any diatonic transposition of the source segment may be added in any key, the result of the basic version (non-augmented) of the source segment may be added, or any other transform of the source segment may be added, to the segment sequence of the new MIDI file O. Thus, augmented versions of the source segments s which may be "closer" harmonically to the target segments t with which they are aligned may be selected for the new MIDI file.

Below, some more specific augmentation mechanisms are presented as examples.

Domain augmentation may be based on harmonic adaptation (augmentation). Harmonic augmentation may comprise exploring variations defined by imposing a small number (e.g., 0, 1 or 2) of pitch changes to the pitches of the source segments. Only small pitch changes (e.g., ±1 semitones) may be considered, so that the resulting augmented source segments s' are close to the original source segment s, i.e., $G(s, s')\approx 0$.

For example, consider a source MIDI file S with P source segments $\{s_l, \ldots, s_P\}$. For each $s_i$, we explore the neighbourhood $\{s_i^1, s_i^2, \ldots\}$ of $s_i$, containing all segments s obtained by imposing a small number of pitch changes to the pitches of $s_i$. Note that, we avoid creating segments with duplicate pitches. Eventually, we keep the new segments $s_i^k$ which are such $H(t, s_i^k)<\min_{l\leq j\leq P} H(t, s_j)$ for at least one target segment t.

Another example of an augmentation mechanism is to allow more transitions between source segments s (including their augmented variants s'). This may be achieved in principle with Deep Hash Nets, e.g., in accordance with Joslyn, K., Zhuang, N., and Hua, K. A. "Deep segment hash learning for music generation", arXiv preprint arXiv: 1805.12176 (2018). In practice, it may be possible to use property (ii) discussed above, that the transition between each two consecutive source segments s in the new MIDI file O is musically similar to a transition between two consecutive source segments s in the source MIDI file S, applied to the augmented variants s' of the source segments s.

Methods and Devices

Figure 2:
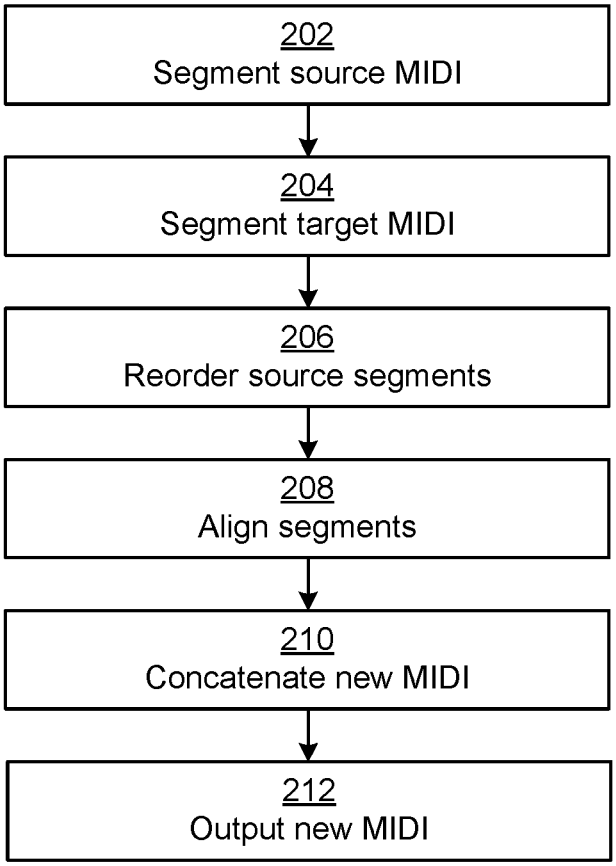
FIG. 2 is a schematic flow chart of a method in accordance with some embodiments.

FIG. 2 illustrates some different embodiments of the method of the present disclosure. The method is for automatically preparing a MIDI file based on a target MIDI file and a source MIDI file. The source MIDI file S is segmented (202) into a plurality of source segments s. Preferably, most or all of the source segments are of the same length, e.g., in respect of number of bars or beats. Then, at least some of the source segments s are reordered (206), e.g., to form a sequence of source segments which may be used for the new MIDI file O. This reordering may be done several times to produce several different potential sequences of source segments for the new MIDI file. The sequence of source segments which is selected for the new MIDI file may be selected based on probabilities, e.g., harmonic and/or graphical probabilities as discussed herein, optionally using Belief Propagation. Then, the segments of the selected sequence of reordered source segments s are concatenated (210) to obtain the new MIDI file O. Preferably, the new MIDI file has the same length, e.g., in respect of number of bars or beats, as the target MIDI file T, e.g., allowing the new MIDI file O to be played together (in parallel) with the target MIDI file T. Then, the new MIDI file O is outputted, e.g., to an internal data storage in the electronic device (e.g., computer such as server, laptop or smartphone) performing the method, to another electronic device (e.g., computer such as server, laptop, smart speaker or smartphone), or to a (e.g., internal or external) speaker for playing the new MIDI file.

In some embodiments, the method may further comprise segmenting (204) the target MIDI file into target segments t. Preferably, most or all of the target segments have the same length(s), e.g., in respect of number of bars or beats, as the source segments s, allowing source and target segments of the same lengths to be aligned with each other. Then, after the source segments have been reordered (206), some or each of the target segments t of the target MIDI file T may be aligned (208) with a corresponding source segments of the reordered source segments s, before the outputting (212) of the new MIDI file. The target segments t, typically remaining in the same order as in the target MIDI file T, forming a sequence of target segments, may be aligned (208) with a sequence of reordered source segments which may form the new MIDI file. Thus, the sequence of target segments may be aligned to a sequence of reordered source segments (typically both sequences having the same length). By aligning the target and source segment sequences with each other, a combined MIDI file may be obtained. Thus, in some embodiments, the aligning (208) of each segment t of the target MIDI file T with a corresponding source segment s of the new MIDI file O results in a combined MIDI file C comprising the target MIDI file T aligned with the new MIDI file O. Then, the outputting of the new MIDI file may be done by outputting the combined MIDI file comprising the new MIDI file.

In some embodiments, each source segment s of the new MIDI file O is harmonically similar to its aligned target segment t. Harmonic similarity may be determined by the harmonic distance H, optionally using harmonic probability, as discussed herein. In some embodiments, each source segment s is harmonically similar to its aligned target segment t based on a harmonic distance H between a pitch profile of the source segment and a pitch profile of the target segment.

In some embodiments, a transition between two consecutive source segments, e.g., $s_i$ and $s_j$, in the new MIDI file O is musically similar to a transition between two consecutive other source segments, e.g., $s_l$ and $s_{l+1}$, in the source MIDI file S. In some embodiments, the transitions are musically similar based on graphical distances G, as discussed herein, e.g., dependent on Hamming distance. In some embodiments, the graphical distances G are such that a graphical distance between a first source segment $s_i$ of the two consecutive source segments $s_i$ and $s_j$ in the new MIDI file O and a first segment $s_l$ of the two consecutive other source segments $s_l$ and $s_{l+1}$ in the source MIDI file S is low and a graphical distance between a second source segment $s_j$ of the two consecutive source segments in the new MIDI file and a second segment $s_{l+1}$ of the two consecutive other source segments in the source MIDI file is also low, e.g., as illustrated in FIG. 1.

As mentioned above, the reordering (206) may be based on Belief Propagation. In some embodiments, the Belief Propagation is dependent on a harmonic probability corresponding to the harmonic distance H between a pitch profile of a source segment s of the reordered source segments and a pitch profile of a target segment t with which the source segment is aligned. The steps of reordering (206) and aligning (208) may e.g., be done iteratively until a reordered source segment s is aligned with a target segment to which there is a relatively small harmonic distance H, corresponding to a high harmonic probability. This may be done for each of the target segments, e.g., until the sequence of target segments is aligned with a sequence of source segments where the combined harmonic distances H between all pairs of target and source segments is relatively small.

In some embodiments, the Belief Propagation is additionally or alternatively dependent on a graphical probability corresponding to graphical distances G of two consecutive source segments $s_i$ and $s_j$ of the reordered source segments and two consecutive other source segments $s_l$ and $s_{l+1}$ in the source MIDI file S. Again, this may be done for each pair of consecutive source segments of the reordered source segments to obtain a combined or average graphical distance which is relatively small.

In some embodiments, as discussed above, at least one of the reordered source segments s is augmented to an augmented source segment s' (still being regarded as a source segment) before the concatenating. Thus, source segments fitting even better with the target segments and/or with each other may be obtained. In some embodiments, the at least one source segment s is augmented by means of a machine learning model, e.g., using a Variational Autoencoder (VAE) and/or by harmonic augmentation comprising imposing a pitch change to a pitch of the source segment.

Figure 3:
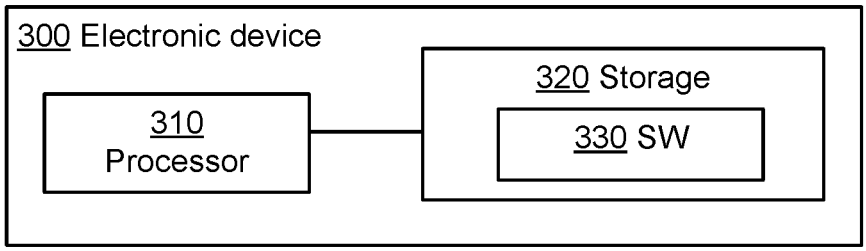
FIG. 3 is a schematic block diagram of an embodiment of an electronic device, in accordance with some embodiments.

FIG. 3 schematically illustrates an embodiment of an electronic device 300. The electronic device 300 may be any device or user equipment (UE), mobile or stationary, enabled to process MIDI files in accordance with embodiments of the present disclosure. The electronic device may for instance be or comprise (but is not limited to) a mobile phone, smartphone, vehicles (e.g., a car), household appliances, media players, or any other type of consumer electronic, for instance but not limited to television, radio, lighting arrangements, tablet computer, laptop, or personal computer (PC).

The electronic device 300 comprises processing circuitry 310, e.g., a central processing unit (CPU). The processing circuitry 310 may comprise one or a plurality of processing units in the form of microprocessor(s). However, other suitable devices with computing capabilities could be comprised in the processing circuitry 310, e.g., an application specific integrated circuit (ASIC), a field programmable gate array (FPGA) or a complex programmable logic device (CPLD). The processing circuitry 310 is configured to execute one or more instructions (referred to as computer program(s) or software (SW)) 330 stored in a storage 320 of one or several storage unit(s) e.g., a memory. The storage unit is regarded as a non-transitory computer-readable storage medium, forming a computer program product together with the SW 330 stored thereon as computer-executable components, as discussed herein and may, e.g., be in the form of a Random Access Memory (RAM), a Flash memory or other solid state memory, or a hard disk, or be a combination thereof. The processing circuitry 310 may also be configured to store data in the storage 320, as needed.

Figure 4:
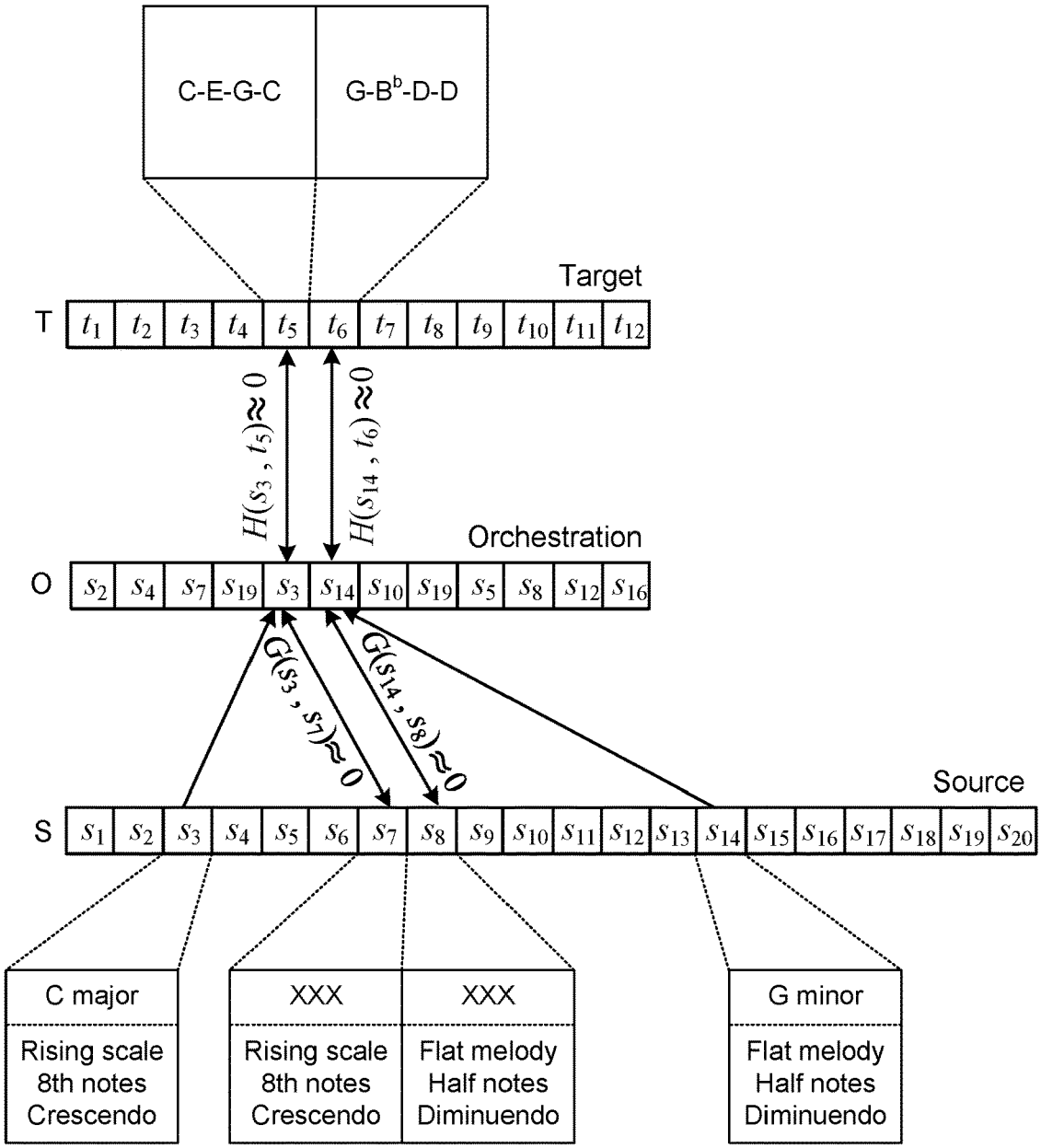
FIG. 4 schematically illustrates an example orchestration of two segments of a target MIDI file based on reordered segments of a source MIDI file in accordance with some embodiments.

FIG. 4 schematically illustrates an example orchestration of a target MIDI file having twelve segments based on reordered segments of a source MIDI file having twenty segments in accordance with some embodiments. The first MIDI file may comprise or otherwise be characterized by a particular style or genre of a musical piece used as a source for orchestration, the second MIDI file may comprise or otherwise be characterized by a particular melody or chord progression of a musical piece targeted for orchestration, and the third MIDI file may comprise or otherwise be characterized by an orchestration of the particular melody or chord progression of the second MIDI file in the style or genre of the first MIDI file.

In the example depicted in FIG. 4, an electronic device (e.g., 300) including one or more processors (e.g., 310) and memory (e.g., 320) storing instructions (e.g., 330) for execution by the one or more processors segments the first MIDI file (source file) into a plurality of source segments ($s_1$ through $s_{20}$), and segments the second MIDI file (target file) into a plurality of target segments ($t_1$ through $t_{12}$). The segmenting operations may correspond with operations 202 and 204 described above.

For each of a plurality of consecutive pairs of first and second target segments (e.g., for a first pair ($t_1$, $t_2$), a second pair ($t_2$, $t_3$), and so forth), the electronic device identifies corresponding source segments. For example, for a particular consecutive pair of first ($t_5$) and second ($t_6$) target segments, the electronic device identifies a first source segment ($s_3$) corresponding to the first target segment ($t_5$) of the consecutive pair, and identifies a second source segment ($s_{14}$) corresponding to the second target segment ($t_6$) of the consecutive pair. The identifying operations may correspond with operations 206 and 208 described above.

Specifically, the electronic device identifies the first source segment ($s_3$) based in part on a determination that the first source segment ($s_3$) is harmonically conformant to the corresponding first target segment ($t_5$), and identifies the second source segment ($s_{14}$) based in part on a determination that the second source segment ($s_{14}$) is harmonically conformant to the corresponding second target segment ($t_6$).

In some implementations, the electronic device determines harmonic conformance using any of the harmonic distance functions and/or operations described above. For example, the electronic device may determine that the first source segment ($s_3$) is harmonically conformant to the corresponding first target segment ($t_5$) based on a comparison of a pitch profile of the first source segment ($s_3$) with a pitch profile of the corresponding first target segment ($t_5$). For example, the first source segment ($s_3$) has a pitch profile characterized by a C major chord, which is harmonically conformant to a melody (C-E-G-C) of the first target segment ($t_5$). In some implementations, the electronic device compares the pitch profile of the first source segment ($s_3$) with the pitch profile of the corresponding first target segment ($t_5$) by comparing Boolean matrices representing piano rolls of the first source segment ($s_3$) and the corresponding first target segment ($t_5$).

To continue the example, the electronic device may determine that the second source segment ($s_{14}$) is harmonically conformant to the corresponding second target segment ($t_6$) based on a comparison of a pitch profile of the first source segment ($s_{14}$) with a pitch profile of the corresponding first target segment ($t_6$). For example, the second source segment ($s_{14}$) has a pitch profile characterized by a G minor chord, which is harmonically conformant to a melody (G-$B^b$-D-D) of the second target segment ($t_6$). In some implementations, the electronic device compares the pitch profile of the second source segment ($s_{14}$) with the pitch profile of the corresponding second target segment ($t_6$) by comparing Boolean matrices representing piano rolls of the second source segment ($s_{14}$) and the corresponding second target segment ($t_6$).

In addition to identifying the first and second source segments ($s_3$) and ($s_{14}$) based in part on their harmonic conformance with the first and second target segments ($t_5$) and ($t_6$), the electronic device may identify the first and second source segments ($s_3$) and ($s_{14}$) based in part on a determination that a transition between the first and second source segments ($s_3$) and ($s_{14}$) is graphically conformant to a transition between any of the consecutive pairs of source segments of the first MIDI file (e.g., a transition between segments of a first consecutive pair ($s_1$) and ($s_2$), a transition between segments of a second consecutive pair ($s_2$) and ($s_3$), and so forth).

In some implementations, the electronic device determines graphical conformance using any of the graphical distance functions and/or operations described above. For example, the electronic device may determine graphical conformance of transitions based on a comparison of (i) a rhythm and/or pitch transition between the first and second source segments ($s_3$, $s_{14}$) with (ii) a rhythm and/or pitch transition between each of a plurality of consecutive pairs of source segments (e.g., ($s_1$, $s_2$), ($s_2$, $s_3$), and so forth). In the example depicted in FIG. 4, the electronic device has determined that the transition between the first and second source segments ($s_3$, $s_{14}$) is most graphically conformant with the transition between the pair of consecutive source segments ($s_7$, $s_8$), because each pair transitions from a rising scale of 8th notes marked by a crescendo to a flat melody of half notes marked by a diminuendo. In some implementations, comparing rhythm and/or pitch transitions comprises determining a Hamming distance between merged piano rolls of the first and second source segments ($s_7$, $s_8$) and merged piano rolls of the consecutive pairs of source segments (e.g., ($s_1$, $s_2$), ($s_2$, $s_3$), and so forth). In this example, the individual chords of the various source segments are not considered in the graphical conformance determinations, and are therefore marked with an XXX in the figure. In some implementations, however, transitions between the individual chords of the consecutive pairs of source segments may be a factor in the graphical conformance determinations.

Since there may be a plurality of source segments with adequate harmonic conformance to various target segments, the graphical conformance determinations ensure that the source segments that are identified for correspondence to respective target segments include stylistic components (e.g., similarities in musical transitions) of the source file. As a result, the orchestrated version of the target file (the orchestration file) may be characterized by a particular style or genre of the source file.

Upon identifying source segments corresponding to each of the target segments, the electronic device generating the third MIDI file (the orchestration file) using the identified first and second source segments for each of the plurality of consecutive pairs of first and second target segments. In some implementations, the electronic device generates the third MIDI file by reordering at least some of the source segments based on their correspondence to respective target segments, and concatenating the reordered source segments. The generating options may correspond with operations 208, 210, and 210 described above. For example, the generating options may correspond with any of the sequence generation and/or domain augmentation functions and/or operations described above.

Miscellaneous

The foregoing description has been described with reference to specific implementations. However, the illustrative discussions above are not intended to be exhaustive or to limit the claims to the precise forms disclosed. Many variations are possible in view of the above teachings. The implementations were chosen and described to best explain principles of operation and practical applications, to thereby enable others skilled in the art.

The various drawings illustrate a number of elements in a particular order. However, elements that are not order dependent may be reordered and other elements may be combined or separated. While some reordering or other groupings are specifically mentioned, others will be obvious to those of ordinary skill in the art, so the ordering and groupings presented herein are not an exhaustive list of alternatives.

As used herein: the singular forms "a", "an," and "the" include the plural forms as well, unless the context clearly indicates otherwise; the term "and/or" encompasses all possible combinations of one or more of the associated listed items; the terms "first," "second," etc. are only used to distinguish one element from another and do not limit the elements themselves; the term "if" may be construed to mean "when," "upon," "in response to," or "in accordance with," depending on the context; and the terms "include," "including," "comprise," and "comprising" specify particular features or operations but do not preclude additional features or operations.

The present disclosure has mainly been described above with reference to a few embodiments. However, as is readily appreciated by a person skilled in the art, other embodiments than the ones disclosed above are equally possible within the scope of the present disclosure, as defined by the appended claims.

What is claimed is:

1. A method of generating a Musical Instrument Digital Interface (MIDI) file, comprising:

at an electronic device including one or more processors and memory storing instructions for execution by the one or more processors:

segmenting a first MIDI file into a plurality of source segments;

segmenting a second MIDI file into a plurality of target segments;

for each of a plurality of consecutive pairs of first and second target segments:

identifying a first source segment corresponding to the first target segment of the consecutive pair; and identifying a second source segment corresponding to the second target segment of the consecutive pair;

wherein identifying the first and second source segments comprises:

determining that the first and second source segments are harmonically conformant to the corresponding first and second target segments; and determining that a transition between the first and second source segments is graphically conformant to a transition between a consecutive pair of source segments; and generating a third MIDI file using the identified first and second source segments for each of the plurality of consecutive pairs of first and second target segments.

2. The method of claim 1, wherein:

the first MIDI file comprises a particular style or genre of a musical piece used as a source for orchestration;

the second MIDI file comprises a particular melody or chord progression of a musical piece targeted for orchestration; and the third MIDI file comprises an orchestration of the particular melody or chord progression of the second MIDI file in the style or genre of the first MIDI file.

3. The method of claim 1, wherein determining that the first and second source segments are harmonically conformant to the corresponding first and second target segments comprises:

comparing pitch profiles of the first and second source segments with pitch profiles of the corresponding first and second target segments; and determining harmonic conformance of the first and second source segments to the corresponding first and second target segments based on the comparing.

4. The method of claim 3, wherein comparing pitch profiles of the first and second source segments with pitch profiles of the corresponding first and second target segments comprises:

comparing Boolean matrices representing piano rolls of the first and second source segments and piano rolls of the corresponding first and second target segments.

5. The method of claim 1, wherein determining that a transition between the first and second source segments is graphically conformant to a transition between a consecutive pair of source segments comprises:

comparing a rhythm and/or pitch transition between the first and second source segments with a rhythm and/or pitch transition between a plurality of consecutive pairs of source segments; and determining graphical conformance of the transition between the first and second source segments to the transition between the consecutive pair of source segments based on the comparing.

6. The method of claim 5, wherein comparing the rhythm and/or pitch transition between the first and second source segments with the rhythm and/or pitch transition between the plurality of consecutive pairs of source segments comprises:

determining a Hamming distance between merged piano rolls of the first and second source segments and merged piano rolls of the consecutive pairs of source segments.

7. The method of claim 1, wherein generating the third MIDI file comprises:

reordering at least some of the source segments based on their correspondence to respective target segments; and concatenating the reordered source segments.

8. An electronic device, comprising one or more processors and memory storing instructions that, when executed by the one or more processors, cause the one or more processors to:

segment a first MIDI file into a plurality of source segments;

segment a second MIDI file into a plurality of target segments;

for each of a plurality of consecutive pairs of first and second target segments:

identify a first source segment corresponding to the first target segment of the consecutive pair; and identify a second source segment corresponding to the second target segment of the consecutive pair;

wherein identifying the first and second source segments comprises:

determining that the first and second source segments are harmonically conformant to the corresponding first and second target segments; and determining that a transition between the first and second source segments is graphically conformant to a transition between a consecutive pair of source segments; and generate a third MIDI file using the identified first and second source segments for each of the plurality of consecutive pairs of first and second target segments.

9. The electronic device of claim 8, wherein:

the first MIDI file comprises a particular style or genre of a musical piece used as a source for orchestration;

the second MIDI file comprises a particular melody or chord progression of a musical piece targeted for orchestration; and the third MIDI file comprises an orchestration of the particular melody or chord progression of the second MIDI file in the style or genre of the first MIDI file.

10. The electronic device of claim 8, wherein determining that the first and second source segments are harmonically conformant to the corresponding first and second target segments comprises:

comparing pitch profiles of the first and second source segments with pitch profiles of the corresponding first and second source segments; and determining harmonic conformance of the first and second source segments to the corresponding first and second target segments based on the comparing.

11. The electronic device of claim 10, wherein comparing pitch profiles of the first and second source segments with pitch profiles of the corresponding first and second source segments comprises:

comparing Boolean matrices representing piano rolls of the first and second source segments and piano rolls of the corresponding first and second target segments.

12. The electronic device of claim 8, wherein determining that a transition between the first and second source segments is graphically conformant to a transition between a consecutive pair of source segments comprises:

comparing a rhythm and/or pitch transition between the first and second source segments with a rhythm and/or pitch transition between a plurality of consecutive pairs of source segments; and determining graphical conformance of the transition between the first and second source segments to the transition between the consecutive pair of source segments based on the comparing.

13. The electronic device of claim 12, wherein comparing the rhythm and/or pitch transition between the first and second source segments with the rhythm and/or pitch transition between the plurality of consecutive pairs of source segments comprises:

determining a Hamming distance between merged piano rolls of the first and second source segments and merged piano rolls of the consecutive pairs of source segments.

14. The electronic device of claim 8, wherein generating the third MIDI file comprises:

reordering at least some of the source segments based on their correspondence to respective target segments; and concatenating the reordered source segments.

15. A non-transitory computer-readable storage medium storing instructions that, when executed by an electronic device with one or more processors, cause the one or more processors to:

segment a first MIDI file into a plurality of source segments;

segment a second MIDI file into a plurality of target segments;

for each of a plurality of consecutive pairs of first and second target segments:

identify a first source segment corresponding to the first target segment of the consecutive pair; and identify a second source segment corresponding to the second target segment of the consecutive pair;

wherein identifying the first and second source segments comprises:

determining that the first and second source segments are harmonically conformant to the corresponding first and second target segments; and determining that a transition between the first and second source segments is graphically conformant to a transition between a consecutive pair of source segments; and generate a third MIDI file using the identified first and second source segments for each of the plurality of consecutive pairs of first and second target segments.

16. The non-transitory computer-readable storage medium of claim 15, wherein determining that the first and second source segments are harmonically conformant to the corresponding first and second target segments comprises:

comparing pitch profiles of the first and second source segments with pitch profiles of the corresponding first and second source segments; and determining harmonic conformance of the first and second source segments to the corresponding first and second target segments based on the comparing.

17. The non-transitory computer-readable storage medium of claim 16, wherein comparing pitch profiles of the first and second source segments with pitch profiles of the corresponding first and second source segments comprises:

comparing Boolean matrices representing piano rolls of the first and second source segments and piano rolls of the corresponding first and second target segments.

18. The non-transitory computer-readable storage medium of claim 15, wherein determining that a transition between the first and second source segments is graphically conformant to a transition between a consecutive pair of source segments comprises:

comparing a rhythm and/or pitch transition between the first and second source segments with a rhythm and/or pitch transition between a plurality of consecutive pairs of source segments; and determining graphical conformance of the transition between the first and second source segments to the transition between the consecutive pair of source segments based on the comparing.

19. The non-transitory computer-readable storage medium of claim 18, wherein comparing the rhythm and/or pitch transition between the first and second source segments with the rhythm and/or pitch transition between the plurality of consecutive pairs of source segments comprises:

determining a Hamming distance between merged piano rolls of the first and second source segments and merged piano rolls of the consecutive pairs of source segments.

20. The non-transitory computer-readable storage medium of claim 15, wherein generating the third MIDI file comprises:

reordering at least some of the source segments based on their correspondence to respective target segments; and concatenating the reordered source segments.

* * * * *